United States Patent [19]

Fritz

[11] Patent Number: 4,702,462

[45] Date of Patent: Oct. 27, 1987

[54] WATER-COOLED LANCE FOR BLOWING OXIDIZING GAS ONTO A METAL MELT

[75] Inventor: Ernst Fritz, Sulzbach-Rosenberg, Fed. Rep. of Germany

[73] Assignee: Klöckner CRA Technologie GmbH, Hamburg, Fed. Rep. of Germany

[21] Appl. No.: 835,534

[22] Filed: Mar. 3, 1986

[30] Foreign Application Priority Data

Mar. 19, 1985 [DE] Fed. Rep. of Germany ..... 3509795

[51] Int. Cl.[4] ..... C21C 5/32

[52] U.S. Cl. ..... 266/225; 266/268; 266/270

[58] Field of Search ..... 266/225, 226, 265, 266, 266/267, 268, 270

[56] References Cited

U.S. PATENT DOCUMENTS 4,190,238 2/1980 Schoop et al. ..... 266/270

FOREIGN PATENT DOCUMENTS 297684 5/1971 U.S.S.R. ..... 266/225
472980 9/1975 U.S.S.R. ..... 266/225
821842 4/1981 U.S.S.R. ..... 266/225

*Primary Examiner*—John P. Sheehan
*Assistant Examiner*—Robert L. McDowell
*Attorney, Agent, or Firm*—Toren, McGeady & Associates

[57] ABSTRACT

A water-cooled lance for blowing oxygen or oxygen containing gas onto a metal melt, for example an iron melt, for afterburning reaction gases from the melt and transfering the heat of afterburning back to the melt comprises a center tube forming a gas supply duct surrounded by further tubes for cooling water. The center tube leads to a head having a plurality of oxygen-blowing nozzles. Each of the nozzles has a plurality of oxygen outlet openings. The outlet openings have their centers lying on two concentric circles and are arranged so that each opening produces an individual gas stream. The axes of the outlet openings are inclined to the longitudinal axis of the lance at angles such that, in a plane perpendicular to the longitudinal axis of the lance and at a distance Lh from the head, the gas streams extend over an annular area in the plane having an inside diameter Di and and outside diameter Da. Lh, Di and Da have the following relationships:
Di:Lh is the range of from 0.15 to 0.6; and,
Da:Lh is the range of from 0.6 to 1.2.

10 Claims, 2 Drawing Figures

WATER-COOLED LANCE FOR BLOWING OXIDIZING GAS ONTO A METAL MELT

This invention relates to water-cooled lances for blowing oxygen or oxygen-containing gas on to a metal melt, especially an iron melt, in order to afterburn reaction gases from the melt and transfer heat from the afterburning back to the melt.

Melts with which the lance is intended to be used generally consist of carbon-containing iron melts, such as are present, for example, in the refining of pig iron in oxygen blowing converters for the production of steel. Oxygen blowing converters are today operated increasingly according to the method of combined blowing, as explained in, amongst other publications, "Metallurgy of Iron" by Gmelin-Durer, Volume 7, published by Springer-Verlag 1984. For the economy of this method, an improvement to the heat balance in order to increase the charge of cold constituents such as scrap, solid pig iron, directly reduced material, iron, manganese and chrome ores, is of significance.

In the refining of, for example, pig iron, the thermal energy released originates principally from the oxidation of the metalloids of the iron, such as carbon, silicon, phosphorus and manganese, and also from a partial slagging of the iron. In some processes, carbon-containing fuels, for example coal or coke, have to be added to the melt, in order to increase the heat supply by combustion of carbon. In order to melt 1 tonne of scrap, in view of the fact that in the iron melt combustion of the carbon to CO only is possible, approximately 400 kg of coal must be added to the melt. By afterburning of the reaction gases CO and $H_2$ from above the melt, to give $CO_2$ and $H_2O$ and by a transfer of the heat thus released to the melt itself, the quantity of fuel required can be considerably reduced. With an afterburning of 40% of the reaction gases and a predominant transfer of the combustion heat to the melt, the aforementioned quantity of coal can be reduced from approximately 400 kg to approximately 160 kg of coal per tonne of scrap. The oxygen demand and the blowing time are also correspondingly reduced. These data illustrate the economic importance of achieving the most complete afterburning of the reaction gases possible for the heat balance in the refining of pig iron to make steel and to provide a resultant increase in the quantity of cold constituents and scrap.

For improving the afterburning of waste reaction gas, for example in a converter and in an electric arc furnace, a number of proposals have been made. One method of increasing the scrap charge in the production of steel is disclosed in German Auslegeschrift No. 27 55 165 and involves the simultaneous feeding of oxygen below and above the melt surface and is characterised in that between 20 and 80% of the total quantity of oxygen is supplied from above the melt through one or more gas jets directed onto the melt surface. The gas jets act through a considerable part of the refining process as free jets blowing into a gas space above the melt and the jets suck in considerable quantities of the converter reaction gases. The oxygen is preferably blown onto the melt surface through side wall nozzles or tuyeres which are installed permanently in a refractory lining of the converter and are protected against premature burning back by a sheath of hydrocarbon gas surrounding the stream of oxygen. With these lateral wall tuyeres, in a simple form consisting of two concentric tubes, the degree of afterburning and the transfer of combustion heat to the melt does not increase on average much above 20%. A change in the distance between the tuyere outlets and the melt is, moreover, not generally possible, but proves always to be advantageous when, at high melt temperatures and low carbon contents, harder oxygen blowing is required in order to reduce the wear of the lining, especially when only small quantities of gas for improving the melt movements are supplied to the melt below its surface.

From the publication "Stahl und Eisen" ("Steel and Iron") 1957, pages 1296 to 1303, it is known in the blowing of oxygen on to a melt from a lance to increase the lance distance from the melt surface in order to improve the afterburning. As our own experiments in a 270 tonne combined blowing oxygen converter have shown, an increase in the distance from the melt surface of a four-hole blowing lance from 2 to 4 m leads to an increase in the degree of afterburning. In combined blowing with an oxygen blowing rate of 70% of the total quantity of oxygen and a lance distance of 4 m, the blowing behaviour with an oxygen feed through bottom nozzles with intermittent lime dust charging could be completely controlled. The afterburning degree could, however, only be raised from about 8% to 13% by these means.

German Offenlegungsschrift No. 31 34 244 describes a two-circuit blowing lance for increasing the afterburning degree in oxygen top blowing with simultaneous inert gas scavenging through bottom refractory blocks. In this lance, the lance head has at least one, and preferably four, main nozzles, which supply oxygen for decarburisation, and an equal number of subsidiary nozzles, which supply the oxygen for the afterburning. In this lance, the axes of the main nozzles are oriented at from 14° to 17° to the lance axis and the axes of the subsidiary nozzles at from 30° to 50° to the axes of the adjacent main nozzles. This lance construction requires blowing with a relatively small distance between the lance head and the surface of the melt, since otherwise the oxygen jets from the subsidiary nozzles strike directly on the refractory lining of the converter which holds the melt and lead to premature wear of the lining of the converter. With a small lance distance, however, the degree of afterburning of the reaction gases issuing from the melt is inevitably strongly influenced by the behaviour of the melt and in particular also by a more or less strong formation of foamed slag. When foamed slang forms, the transverse gas flow which is decisive for sucking the reaction gases into the oxygen jets cannot become established. The supply of heat from afterburning can thus only with difficulty be balanced and therefore leads to disadvantages in carrying out the process. Furthermore, small lance distances result in an increased formation of deposits on the lance and thus in a reduced life of the lance head.

The object of the present invention is to provide a lance for the blowing of oxygen or oxygen-containing gases as initially described which, while relatively simple in construction, avoids or reduces the disadvantages of the known lances, produces an increase in combustion of the reaction gases from the metal melt, and makes possible an effective transfer of the combustion heat thereby arising back to the melt. This increases the utilisable introduction of heat in refining and enables higher changes of cold constituents to be smelted, without endangering the refractory lining of the smelting vessel, the lance itself and the chimney for waste gases by excessive waste gas temperatures.

To this end, according to this invention, such a lance comprises a gas supply duct leading to a head which includes a plurality of nozzles having a plurality of gas outlet openings, the gas outlet openings having centre points lying on at least two concentric circles and the gas outlet openings being located and directed to produce individual streams of the oxygen or oxygen-containing gas.

An important feature of the lance in accordance with the invention consists in blowing the oxidising gas from a large number of nozzle outlet openings as mutually separate individual jets onto the melt in such a manner that on their blowing path they suck in a large amount, i.e. several times the quantity of blown-in gas, of combustible reaction gases from the space above the melt. The important dimensions of a conventional oxygen blowing lance are preferably largely maintained. Suprisingly, a lance constructed in accordance with the invention satisfies this condition. Preferably the nozzle openings are connected in groups of from two to five, preferably three, via each nozzle piece to the oxygen supply duct. This construction of the lance head makes it possible simultaneously to provide a high number of nozzle openings and sufficient cooling of the lance by circulating water in order to ensure a long lance life. Furthermore, the invention permits already existing lances of oxygen blowing converters to be converted into lances in accordance with the invention just by fitting them with new heads. By retaining the usual lance diameter, the heat losses as a consequence of lance cooling remain within the usual order of magnitude.

In the lance in accordance with the invention, as already mentioned, the outlet openings for the oxidising gas are disposed in groups on two or more concentric circles on the lance head. On these circles, the spacing between the nozzle openings is approximately equal. The number of openings on each circle preferably increases from the centre outwards, i.e. with increasing circle diameter. With advantage, the lance may be so constructed that the gas outlet directional axes of the outlet openings are inclined relative to the longitudinal axis of the lance and, in a plane which is perpendicular to the lance axis and is at a distance Lh from the head, the individual gas jets or streams issuing from the openings extend over an annular area having an inside diameter Di and an outside diameter Da, Lh, Di and Da being related as follows:

Di : Lh is in the range of from 0.15 to 0.6; and,

Da : Lh is in the range of from 0.6 to 1.2. In practice, the surface of the melt is situated on the plane at the distance Lh from the head.

When these conditions are satisfied, an optimum afterburning of the reaction gases from the melt is obtained, in conjunction with an effective transfer of the combustion heat producted to the melt. For example, in a 270 tonne converter, the lance head distance from the melt surface was varied from 2 m to 5 m. The clear diameter of the newly lined converter was 6.2 m and the annular zone of impact for the gas jets or streams varied in relation to the lance distance between Di=0.5 m to 1.2 m and Da=1.7 m to 4.5 m.

In one example, the lance has eighteen nozzle openings, twelve being on an outer circle of diameter approximately 26 cm and six on an inner circle of diameter approximately 19 cm. Blowing was carried out at a rate of 2.6 $Nm^3$ of gas per minute and per tonne of liquid iron with a simultaneous bottom blowing rate of approximately 1 $Nm^3$ of oxygen per minute and per tonne of liquid iron with intermittent lime dust charging. With this method of operation, afterburning degrees of approximately 40% with a heat transfer of approximately 80% could be achieved. The efficiency of heat transfer is defined as the heat introduced into the melt compared with the theoretically resulting combustion heat from CO and $H_2$ conversion to $CO_2$ and $H_2O$, less the unavoidable heat losses in the converter waste gas, which result from the increase in specific heat. With melt charges comprising, for example, 0.3% silicon, increases in scrap charge compared with refining with conventional lances of more than 110 kg/tonne of liquid steel could be achieved. The iron content of the slags, at approximately 11%, for a carbon content of the steel melt of 0.05%, was relatively low. The carbon burnt away uniformly during the main decarburisation period as a function of the quantity of oxygen supplied. The temperature accuracy obtained and the reproductibility of the afterburning proved extremely reliable, so that the melt could be tapped directly, i.e. after a check with a probe (temperature measurement and carbon determination), without further sampling.

With the lance in accordance with the invention, the oxygen or oxygen-containing gas, for example air, may leave the outlet openings at the lance head at sonic speed. It is also possible, however, to construct all the nozzles or every alternate nozzle as a Laval nozzle, in order to cause the oxidizing gas to leave the lance head at up to twice sonic speed.

The diameter of the nozzle outlet openings may bear a specific ratio to the distance Lh between the lance head and the melt surface. It has been found advantageous, in this connection, if the ratio of opening diameter to lance distance Lh is from 0.003 to 0.01.

The angles of inclination of the axes of the nozzle openings to the lance axis at the lance head may differ from each other and thereby to keep the distances between the individual gas streams on their paths towards the melt surface different from each other. Not only can the distances of the gas streams from one another be varied, but the gas streams can also touch or cross one another in order to produce additional turbulence with the reaction gas in the reaction space above the melt and thereby incite and increase afterburning. This additional thorough mixing of oxidising gas and reaction gas from the melt has proved very effective at high outlet speeds of the gas streams from the nozzle head.

Moving of the lance has proved advantageous for optimising the afterburning. Even a relatively simple oscillating movement by raising and lowering the lance by, for example, ±0.15 m to ±1.5 m, resulted in a favourable influence upon the afterburning degree and upon the transfer of combustion heat to the melt. Still more effective than raising and lowering of the lance, can be a uniform rotation of the lance at a relatively high lance distance above the melt surface. A combination of these two movements is also of advantage. A prerequisite for the rotational movement of the lance is, of course, a multiple rotatable joint at the entry to the lance for the gas supply. A moderate lance rotation itself can be obtained by a mechanism comprising friction rollers disposed above the entry of the lance into a chimney of the melt-vessel. By this lance movement, it is possible to increase the average afterburning by 5 to 10% per batch.

The lance may also include in the central region of the lance head one or more nozzle openings which are supplied by a separate feed duct and optionally intermediate pieces, for blowing solid materials such as lime, ore and, especially carbon-containing fuels, on to the melt. By these additional nozzle openings, preferably ground particulate fuel, for example coal or coke, may be blown onto the melt in order to increase still further the introduction of heat into the melt. Since the lance in accordance with the invention improves the afterburning of the reaction gases generated, the thermal efficiency of the supplied fuels is also increased. This increase can be promoted if crushed cold constituents, such as ore, lime and limestone are added to the fuel, which are thus pre-heated in the gas space above the melt. This possibility of heating up cold solid particles exists especially where the distance from the blowing lance to the melt surface is large and consequently long distances have to be traversed, even if no fuels or fuel-ore or other mixtures are blown onto the melt and these particles are introduced into the very hot afterburning combustion streams.

An example of a lance in accordance with the invention will now be described with reference to the accompanying drawings in which.

Figure 1:
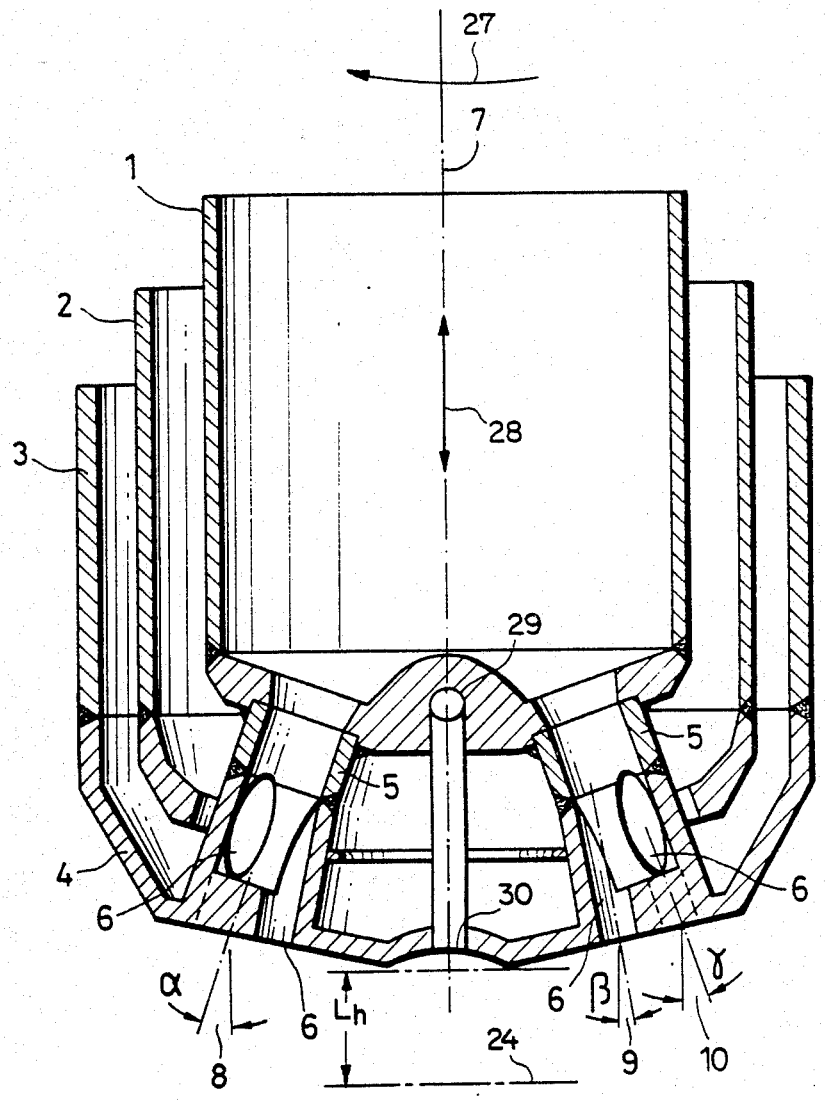
FIG. 1 is a longitudinal section through a head of the lance.
Figure 2:
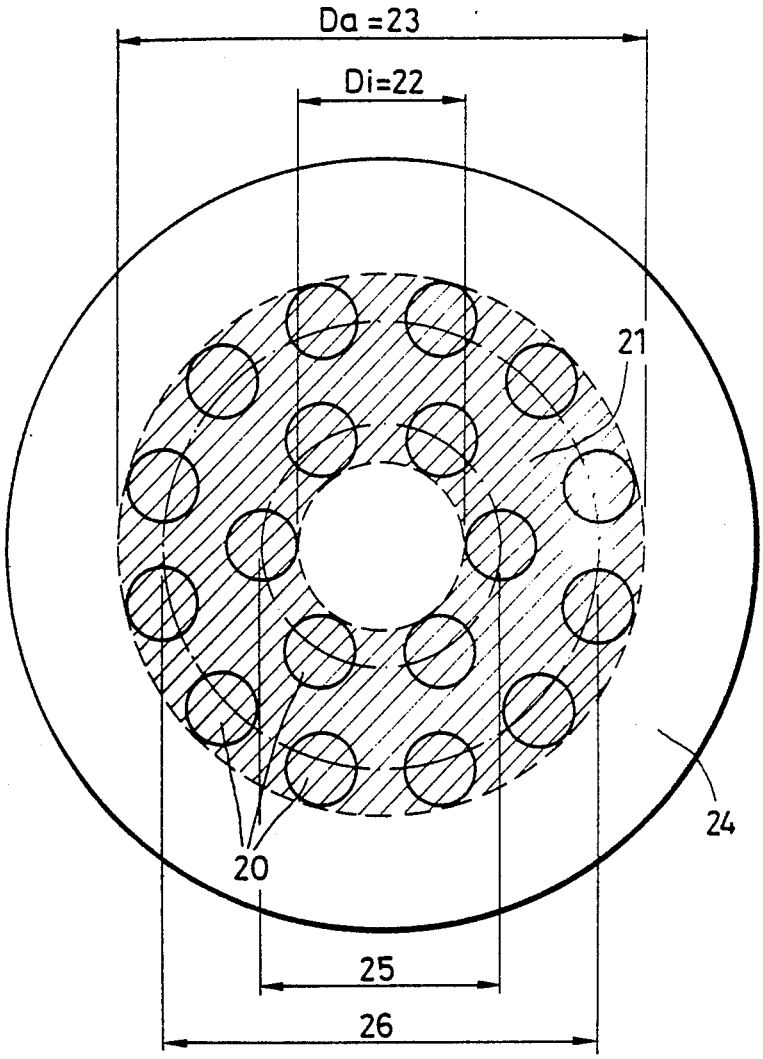
FIG. 2 is a diagram of the surface of a static melt showing the regions of impact of the gas streams from the lance during blowing with the lance at a specific height above the surface.

The lance comprises three concentric tubes 1, 2, 3 with a welded-on lance head 4, made for example of highly pure, die-forged copper. Through the inner tube 1, which has an internal diameter of 250 mm, oxygen flows to the lance head 4. The outer tube 3 has an external diameter of 410 mm and the intermediate tube 2 a diameter of 340 mm. In the annular space between the tubes 1 and 2, cooling water is supplied to the lance head, and the water is returned in the annular space between the tubes 2 and 3.

The lance head 4 comprises six tubular nozzles 5 each having three outlet openings 6 departing from the internal surface of the nozzle. The oxygen consequently flows out of the oxygen tube 1 via the nozzles 5 to the outlet openings 6 and emerges from the head 4 in the form of a plurality of individual jets or streams.

The nozzles 5 are inclined relative to the longitudinal axis 7 of the lance. The angle of inclination 8 depends upon the form of the converter with which the lance is used and its size, and ranges from 10° to 25°, in the present example 20°.

The angles of inclination 9 and 10 of the axes of the outlet openings 6 of a nozzle 5 differ, whereas the angle of inclination 10 is the same as the angle of inclination 8. Preferably, this is the case for those outlet openings 6, the gas stream impingement areas 20 of which in an annular area 21 lie near to its external diameter Da 23 on the melt surface 24.

The angle of inclination 9 of those outlet openings 6, the gas streams from which strike the melt surface 24 near the inner diameter 22 of the annular area 21, is preferably approximately 10° smaller than the angle of inclination 10 of the outer outlet openings 6 and consequently is approximately from 5° to 20°.

The nozzles 5 each have three outlet openings 6, one outlet opening being shown entirely in the sectional view of FIG. 1, the second being shown partly and the third not at all. As already described, the gas jets or streams from the outlet openings having the angle of inclination 9 strike the melt surface 24 near the inner diameter 22 in the annular area 21. The six impingement areas 20 of these gas jets lie at approximately equal distances from one another on a circle having a diameter 25. The outlet openings 6 having the angle of inclination 10 and the further outlet openings 6, not shown, touch the melt surface 24 near the diameter 23 of the annular area 21. These twelve impingement areas 20 of the outer gas jets also lie approximately on a circle and the distance between the individual impingement areas 20 is also equal. Consequently, the two outlet openings 6 of each nozzle piece 5 for the outer gas jets are also inclined in this direction. The angle of inclination of these two outlet openings relative to one another lies in relation to the lance axis at an angle of between 5° and 20°.

The lance head 4 has a total of six nozzles 5 each having three outlet openings 6. The gas jets from the openings each blow separately onto the melt surface 24 and have their impingement areas 20 inside the annular area 21 at approximately equal distances from one another on two circles having the diameters 25 and 26 respectively. The peripheries of the approximately circular impingement areas 20 touches the diameter 22 of the annular area 21 and correspondingly the periphery of the impingement areas 20 touches the outer diameter 23 of the annular area 21.

The lance in accordance with the invention has proved excellent in the refining of steel in oxygen blowing converters and has led to surprisingly good results in respect of the degree of afterburning of the reaction gases from the melt and the transfer of the heat evolved during combustion to the melt. Thus, compared with the usual lance constructions, for example a four-hole blowing lance, with the lance in accordance with the present invention the degree of afterburning may, surprisingly, be increased by a factor of approximately three, namely from about 13% to above 40%. The transfer of combustion heat, with an efficiency of more than 80%, was also exceptionally high.

FIG. 1 of the drawing further shows an opening 29 for supplying solid particulate material to the head and an opening 30 serving as a further gas outlet opening. A duct for effecting communication between openings 29 and 30 is also included.

Arrows 27 and 28, respectively, schematically indicate that the lance can be rotated and raised and lowered.

The distance between the head 4 and melt surface 24 is identified by Lh.

I claim:

1. In a lance for blowing oxidizing gas onto a metal melt for afterburning reaction gases from said melt and transferring heat from said afterburning to said melt, said lance including means defining a gas supply duct extending along said lance and means for water-cooling said lance, the improvement comprising a head on said lance, a plurality of nozzles in said head, means communicating said nozzles with said gas supply duct and means defining a plurality of gas outlet openings in said nozzles, said gas outlet openings having center points lying on at least two concentric circles and said gas outlet openings being located and directed to produce individual streams of said oxidizing gas issuing therefrom.

2. A lance as claimed in claim 1, wherein said lance has a longitudinal axis and said gas outlet openings have gas outlet directional axes, said gas outlet directional axes being inclined to said longitudinal axis, and wherein, in a plane which is perpendicular to said longitudinal axis and is at a distance Lh from said head, said gas streams extend over an annular area having an inside diameter Di and an outside diameter Da, Lh, Di and Da being related as follows:

Di : Lh is in the range of from 0.15 to 0.6; and,

Da : Lh is in the range of from 0.6 to 1.2.

3. A lance as claimed in claim 2 wherein said gas outlet openings are circular and said plane coincides with the surface of said melt, the ratio of the diameters of said gas outlet openings to said distance Lh being in the range of from 0.003 to 0.01.

4. A lance as claimed in claim 1, in which each of said nozzles includes means defining three of said gas outlet openings, a center point of one of said three gas outlet openings of each of said nozzles lying on an inner one of said concentric circles and center points of the other two of said three gas outlet openings of each of said nozzles lying on an outer one of said concentric circles.

5. A lance as claimed in claim 1, said lance having a longitudinal axis and said gas outlet openings having gas outlet directional axes, said gas outlet directional axes being inclined to said longitudinal axis, wherein said gas outlet directional axes are inclined to said longitudinal axis at angles which are different from each other.

6. A lance as claimed in claim 1, said lance having a longitudinal axis and said gas outlet openings having gas outlet directional axes, said gas outlet directional axes being inclined to said longitudinal axis, wherein said gas outlet directional axes of said gas outlet openings of each of said nozzles are inclined to said longitudinal axis at angles which are different from each other.

7. A lance as claimed in claim 1, in which each of said nozzles includes means defining from two to five of said gas outlet openings.

8. A lance as claimed in claim 1, further comprising means for supplying solid particulate material to said head, means defining at least one further gas outlet opening and means communicating said at least one further gas outlet opening to said means for supplying said solid particulate material.

9. A lance as claimed in claim 1, further comprising means rotationally mounting said lance and drive means for rotating said lance.

10. A lance as claimed in claim 1, further comprising means mounting said lance for longitudinal movement thereof and drive means for lifting said lance away from said melt.

* * * * *